United States Patent [19]

Steiner

[11] Patent Number: 4,492,255

[45] Date of Patent: Jan. 8, 1985

[54] APPARATUS FOR GUIDING A FLUID MEDIUM DRIVEN WEFT THREAD IN THE SHED OF A WEAVING MACHINE AND USE OF THE APPARATUS AT A MULTIPLE LONGITUDINAL TRAVERSING SHED WEAVING MACHINE

[75] Inventor: Alois Steiner, Rieden, Switzerland

[73] Assignee: Sulzer-Rüti Machinery Works Limited, Rüti, Switzerland

[21] Appl. No.: 575,467

[22] Filed: Jan. 30, 1984

Related U.S. Application Data

[62] Division of Ser. No. 241,934, Mar. 9, 1981, Pat. No. 4,438,790.

[30] Foreign Application Priority Data

Mar. 27, 1980 [CH] Switzerland ..... 2440/80

[51] Int. Cl.[3] ..... D03D 47/30

[52] U.S. Cl. ..... 139/11; 139/28

[58] Field of Search ..... 139/11, 11 A, 28, 435

[56] References Cited

U.S. PATENT DOCUMENTS

| | | | |
|---|---|---|---|
| 3,796,236 | 3/1974 | Kamp | 139/435 |
| 4,290,458 | 9/1981 | Steiner | 139/11 A |
| 4,291,729 | 9/1981 | Steiner | 139/28 |
| 4,425,946 | 1/1984 | McGinley | 139/11 A |

FOREIGN PATENT DOCUMENTS

| | | | |
|---|---|---|---|
| 1449084 | 7/1966 | France | 139/435 |
| 409812 | 10/1966 | Switzerland | 139/435 |
| 586298 | 3/1977 | Switzerland | 139/435 |

*Primary Examiner*—Henry S. Jaudon

*Attorney, Agent, or Firm*—Werner W. Kleeman

[57] ABSTRACT

An apparatus for guiding a weft or filling thread in the shed of a weaving machine, the weft thread being driven by a flowing fluid medium, comprises two lamellae combs which can dip into and out of the warp threads. The lamellae or equivalent plate-like guide elements of the lamellae combs each possess a through-pass opening for guiding the weft thread and a thread exit or outlet opening. When the lamellae are in a position completely immersed in the shed they are interleaved or shoved into one another and form a guide channel for the weft threads, this guide channel being coherent or continuous in the weft insertion direction. Hence, the thread exit or outlet openings are sealed, so that the guide channel also is continuously closed in radial direction. The closed guide channel renders possible, on the one hand, a controlled flight of the weft thread, a reduced energy consumption and driving of the weft thread both by a blowing action and also by a suction action and, on the other hand, can be particularly advantageously employed at a multiple longitudinal traversing shed loom containing a weaving rotor.

14 Claims, 6 Drawing Figures

APPARATUS FOR GUIDING A FLUID MEDIUM DRIVEN WEFT THREAD IN THE SHED OF A WEAVING MACHINE AND USE OF THE APPARATUS AT A MULTIPLE LONGITUDINAL TRAVERSING SHED WEAVING MACHINE

CROSS REFERENCE TO RELATED APPLICATION

This application is a divisional application of my commonly assigned copending U.S. application Ser. No. 06/241,934, filed Mar. 9, 1981, now U.S. Pat. No. 4,438,790, granted Mar. 27, 1984.

BACKGROUND OF THE INVENTION

The present invention relates to a new and improved construction of an apparatus for guiding a weft or filling thread in a shed of a weaving machine, the weft thread being driven by a flowing fluid medium.

Generally speaking, the apparatus of the present development is of the type comprising two lamellae combs formed of lamellae or other equivalent guide elements and which can dip into and out of the warp threads. The plate-like guide or lamellae elements of the lamellae combs each possess a throughpass opening for guiding the weft thread and a thread exit or outlet opening. In their effective or operative position, where such lamellae completely dip or immerse into the shed, such lamellae are interleaved or pushed into one another and form, by means of their throughpass openings, a coherent or continuous guide channel for the weft threads in the weft insertion direction.

With a prior art apparatus of the aforementioned type, as has been disclosed in U.S. Pat. No. 3,557,845, granted Jan. 26, 1971, the thread exit or outlet openings, the so-called thread-out or dethreading slots, at each lamellae comb are arranged at a different portion of the circumference of the throughpass openings, so that in the effective or operative position of the lamellae combs each thread-out slot of a lamella merges, in the weft insertion direction, at a solid wall portion of the immediately neightboring lamellae. In this way there should be prevented, among other things, that the weft threads, during their insertion, will be laterally blown out of the thread-out slots and remain caught at the warp threads. This objective could be partially achieved, but it was not possible to completely maintain under control the weft insertion since it was found that from time to time weft threads became caught at the lamellae combs.

SUMMARY OF THE INVENTION

Therefore, with the foregoing in mind, it is a primary object of the present invention to provide an apparatus of the type described which is not associated with the aforementioned drawbacks and limitations of the prior art constructions.

Another and more specific object of the present invention aims at improving upon this state-of-the-art apparatus so that the weft threads, during their insertion, no longer can become caught at the lamellae combs or the like.

A further important object of the present invention is to provide an improved apparatus for guiding a fluid medium driven weft thread in the shed of a weaving machine and to the use of such apparatus at a multiple longitudinal traversing shed weaving machine, which apparatus is relatively simple in construction and design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the apparatus of the present development is manifested by the features that in the aforementioned effective or operative position the thread outlet openings of the lamellae or equivalent guide elements are sealed and the guide channel also is continuously closed in radial direction.

Since the guide channel now is actually closed and no longer possesses at its walls any depressions or sinks for the flowing fluid medium, the weft thread no longer is deflected in the direction of such sinks and no longer can become caught or entrapped at the wall of the guide channel. Also since air cannot escape because of the closed wall of the channel there is realized as a further advantage a reduction in the consumption of air. Finally, with appropriate design of the inventive apparatus there is available a guide channel which is practically airtight at its wall, so that for the first time with weaving machines or looms of this type there is afforded the possibility of laying the weft threads, not merely by application of a blowing action, rather by a suction action. The benefits of a suction action are readily apparent to those skilled in the art and need not be further explained since it is clear that the weft thread can be considerable better controlled when there is applied a pure traction or tension force from the front of the weft thread instead of pressure at the rear thereof, and thus, such weft thread has a quieter weft insertion flight and, additionally, there can be realized an appreciable reduction in the expenditure in energy.

As already heretofore explained the invention also concerns the use of the aforementioned apparatus at a multiple longitudinal traversing shed weaving machine or loom containing a weaving rotor which is provided at its circumference with combs of shed-retaining elements for the warp threads in order to form migrating rows of open sheds.

This use of the inventive apparatus or machine is manifested by the features that there are provided at the weaving rotor for each comb of shed-retaining elements and thus for each row of open sheds two lamellae combs of the aforementioned type which can dip into and out of the sheds.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
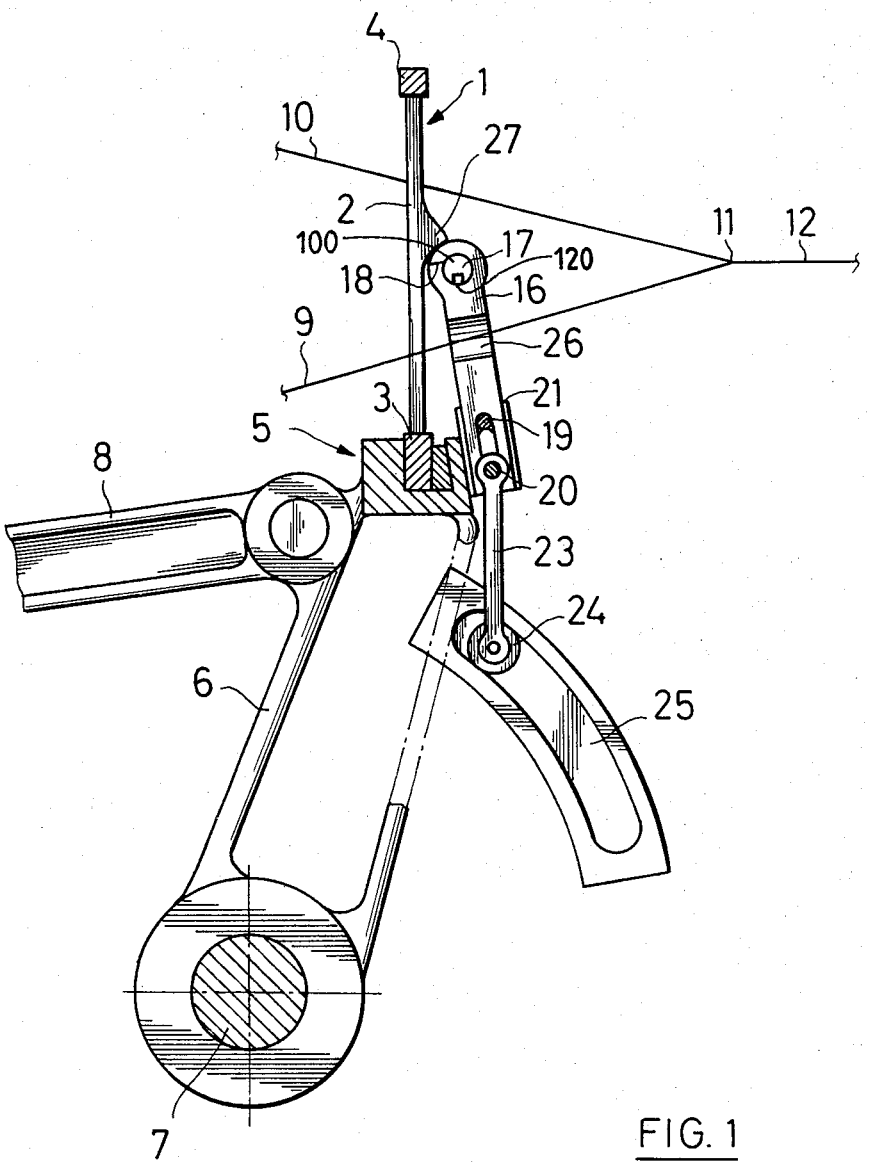
FIG. 1 is a schematic cross-sectional view through the shed of a pneumatic loom.

Describing now the drawings it is to be understood that only enough of the weaving machine or loom has been shown so as to enable those skilled in the art to readily understand the underlying principles and concept of the present invention and to simplify the illustration of the drawings. Turning attention now to FIG. 1 there has been shown in sectional view a pneumatic loom which, as illustrated, possesses a reed 1 having reed blades or teeth 2, the ends of which are retained at a lower mounting or fixing ledge 3 and an upper mounting or fixing ledge 4 or equivalent structure. The lower mounting ledge 3 is attached in conventional manner at the sley 5 which is supported by sley arms 6. These sley arms 6 are pivotably mounted upon a sley shaft 7 arranged in the loom frame and are driven by thrust rods 8 or equivalent drive means which, in turn, are operatively connected with a not particularly illustrated drive mechanism, for instance a crank. By means of this drive mechanism or drive it is possible to periodically move the sley 5 together with the reed 1, during operation of the loom, back and forth between the position shown in FIG. 1 where the reed 1 assumes a position furthest away from the weft thread beat-up position and the actual weft thread beat-up position. Between the reed teeth or blades 2 or equivalent structure there are threaded-in, in conventional manner, warp threads 9 and 10 which experience a shed forming movement by the action of not particularly illustrated but conventional heddles of a shed-forming device. The weft or filling thread which is inserted in each case by the action of, for instance an air nozzle arranged laterally of the sheet of warp threads is beaten-up by the reed teeth 2 at the cloth fell 11 of the already produced fabric or cloth 12.

Since the air jet which drives the weft thread, as is known in this technology, rapidly diverges, it is necessary when working with pneumatic looms to provide means for the constriction or bundling and guiding of the air jet, and thus, the weft thread in the shed. Such means will now be described based upon the showing of FIGS. 1 to 3.

As illustrated, the aforementioned means for introducing a weft thread into an open shed are constituted by a guide arrangement composed of two lamellae combs 13 and 14 comprising a predetermined number of lamellae or plate-like elements 15 and 16, respectively, or equivalent structure. All of the lamellae or plate-like elements 15 and 16 possess a respective throughpass opening 17 for guiding the weft thread and a thread outlet or exit opening 18 confronting the reed 1. The lamellae or lamellae elements 15 and 16 of each lamellae or guide comb 13 and 14, respectively, are each fixedly mounted upon a respective rod or bar member 19 and 20. The rods 19 and 20 are guided, on the one hand, in guides 21 mounted at the sley 5 and, on the other hand, are supported by drive levers 22 and 23, respectively. The drive levers 22 and 23 carry at their ends facing away from the rod members 19 and 20 a respective control roll or cam follower 24 which travels in a machine-fixed control cam 25 or equivalent structure.

Figure 3:
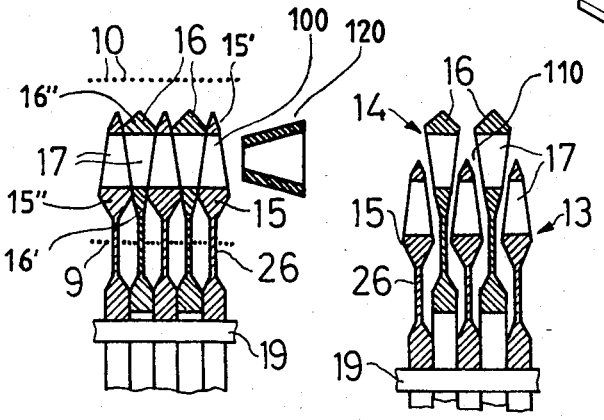
FIG. 3 is a vertical sectional view through the guide channel of the loom of FIG. 1 and illustrating the same in two operating conditions.

The lamellae 15 and 16 possess in their lengthwise direction a wedge-shaped cross-sectional configuration, wherein the tip 15' of the wedge in the case of the lamellae 15 is directed upwardly and in the case of the lamellae 16 such tip 16' is directed downwardly, as best seen by referring to FIG. 3. By virtue of the drive action carried out by means of the rods or rod members 19 and 20, drive levers 22 and 23, the cam follower or control roll 24 and the control cam 25, both of the lamellae combs 13 and 14, during the pivotal movement of the sley 5, are periodically interleaved or shoved into one another and retracted away from one another, respectively. In the interleaved operative position illustrated at the left-hand portion of FIG. 3, corresponding to the sley position of FIG. 1, where there occurs weft insertion, the throughpass openings 17 of the lamellae 15 and 16 of both lamellae combs 13 and 14, respectively, form a guide channel, generally indicated by reference character 100, for the weft threads which is continuous or coherent in the weft insertion direction. At this point it is mentioned that the terms "lamellae combs" and "lamellae", whether used in the singular or plural, are employed in a broader sense as constituting guide arrangements in the form of guide combs formed of individual guide elements or the like coacting in the stated manner.

As best seen by referring to FIGS. 2 and 3, the lamellae 15 and 16 are provided below their respective wedge-shaped portions 15" and 16" with a respective constricted or narrower portion 26, so that sufficient space is available for the warp threads 9, in the lower shed, between the individual lamellae.

Due to the pivotal movement of the sley 5 the lamellae combs 13 and 14, during each beat-up motion, are pivoted out of the shed and during each return movement of the sley 5 are pivoted back into the shed. Hence, the warp threads 9 of the lower shed not only must arrive from the constricted or narrower portions 26 to a location over the outer edge of the lamellae, but there also must be possible a shed change of the warp threads 9 and 10. This is rendered possible in that the lamellae 15, during the beat-up phase of the reed 1, are pulled by the action of their drive downwardly relative to the lamellae 16. Hence, there is formed between the wedges or wedge surfaces 15" and 16" of the individual lamellae 15 and 16 an intermediate space 110 which is adequate for the passage of the warp threads 9 and 10. This position of the lamellae combs 13 and 14, illustrated at the right-hand portion of FIG. 3, and which is attained directly after each weft insertion, is maintained throughout the beat-up phase and during a portion of the return movement of the sley 5, until the lamellae combs 13 and 14 again completely dip into the shed and the warp threads 9 of the lower shed are located between the constricted or narrower portions 26.

As already explained, the lamellae 15 and 16 each possess a thread exit or outlet opening 18, confronting the reed 1, and serving for the departure of the weft thread out of the guide channel 100 formed by the related throughpass opening 17. The thread outlet openings 18 have the shape of a slot and the weft thread, by virtue of the pivotal movement of the sley 5 and the lamellae combs 13 and 14, automatically moves through such slot out of the lamellae 15 and 16. The lamellae 15 and 16 are elastically structured at their upper portion, in other words at the region of the openings 17, which can be conveniently accomplished through the selection of a suitable material, for instance a plastic material such as polyacetal. Due to this elastic construction of at least the upper leg 95 (FIG. 2) of the lamellae 15 and 16 it is possible to close the thread exit opening 18 during the weft insertion, and thus, to seal the guide channel 100 also in radial direction.

For this purpose the reed teeth or wires 2 or the like are provided with a nose-like projection 27 (FIG. 1) serving as a stop or impact means for the lamellae 15 and 16. These lamellae or lamellae elements 15 and 16, during the return movement of the sley 5 with interleaving of both of the lamellae combs 13 and 14, are pressed against the projections or nose-like protuberances 27, so that the thread exit or outlet openings 18 are closed. Directly after completion of the weft insertion both of the lamellae combs 13 and 14 are load relieved to such an extent that the thread exit openings 18 can open to permit throughpassage of the weft thread.

Consequently, the wedge-shaped downwardly extending lamellae 16 only perform the stroke or displacement movements needed for closing and opening the thread exit openings 18, whereas the wedge-shaped upwardly extending lamellae 15, in addition to such displacement movement, also accomplish a relative movement with respect to the lamellae 16 as is apparent from the showing of FIG. 3. In FIG. 2 there have been illustrated two lamellae 15 and 16 in a position corresponding to the condition analogous to that prevailing at the right-hand portion of FIG. 3. The arrangement of the nose-like protruberances or projections 27 at the reed teeth or wires 2 is of course chosen such that the projections 27, during the beat-up movement of the reed 1, completely depart out of the shed and the beat-up of the weft thread is accomplished by the linear portion of the reed teeth 2 above the projections 27.

The described apparatus containing the closed guide channel 100 has the appreciable advantage that the drive of the weft thread not only can be accomplished by a blowing action but also by exerting a suction action. In this case there is provided at the weft thread-exit side of the lamellae combs 13 and 14 a suction nozzle or the like, as generally indicated schematically in FIGS. 1 and 2 by reference character 120, which is in alignment with the guide channel 100, this suction nozzle 120, if desired, can be arranged to be moveable in the weft insertion direction and during each weft insertion can be pressed against the outer lamella or guide element of the interleaved lamellae combs 13 and 14. If the upper legs 95 of the lamellae 15 and 16 are sufficiently elastic and easily bendable and the thread exit or outlet openings 18 are sufficiently narrow, then it can even be possible to close the openings 18 by the negative pressure prevailing in the guide channel and caused by the suction action, so that the use of the nose-like projections 27 (FIG. 1) can be dispensed with.

Since the warp threads, during the dipping-in and the dipping-out of the lamellae combs and during the shed change slide along the end surfaces of the lamellae 15 and 16 there is ensured that no dust or other contaminants can deposit at such locations. It also would be possible to use lamellae having parallel instead of wedge-shaped converging end surfaces. In that case, however, both of the lamellae combs must always be completely pivoted away from one another in order to render possible the passage of the warp threads between the individual lamellae. Additionally, in this case it would be advantageous, through the application of external pressure in the weft insertion direction and in the counter direction, to press the lamellae laterally against one another. This pressure could be produced, for instance, at one side of the shed by the weft laying or insertion nozzle, in other words the blow or suction nozzle, and at the other side by the use of a fixed stop.

It is also not absolutely necessary that the stop for closing the thread outlet or exit openings 18 be constituted by the nose-like projections 27 and the reed 1. Such stop or impact means could likewise be structured in a lamellae comb-like fashion and could be pivoted from above into the shed. In this case the opening of the thread outlet openings 18, following the weft insertion, could be accomplished by a movement of the stop or impact comb and as to both of the lamellae combs 13 and 14 it is only necessary for the lamellae comb 13 containing the wedge-shaped upwardly converging lamellae 15 to be elevationally displaceable, whereas the lamellae comb 14 could be fixedly mounted at the sley 5 and would not need any drive.

Figure 2:
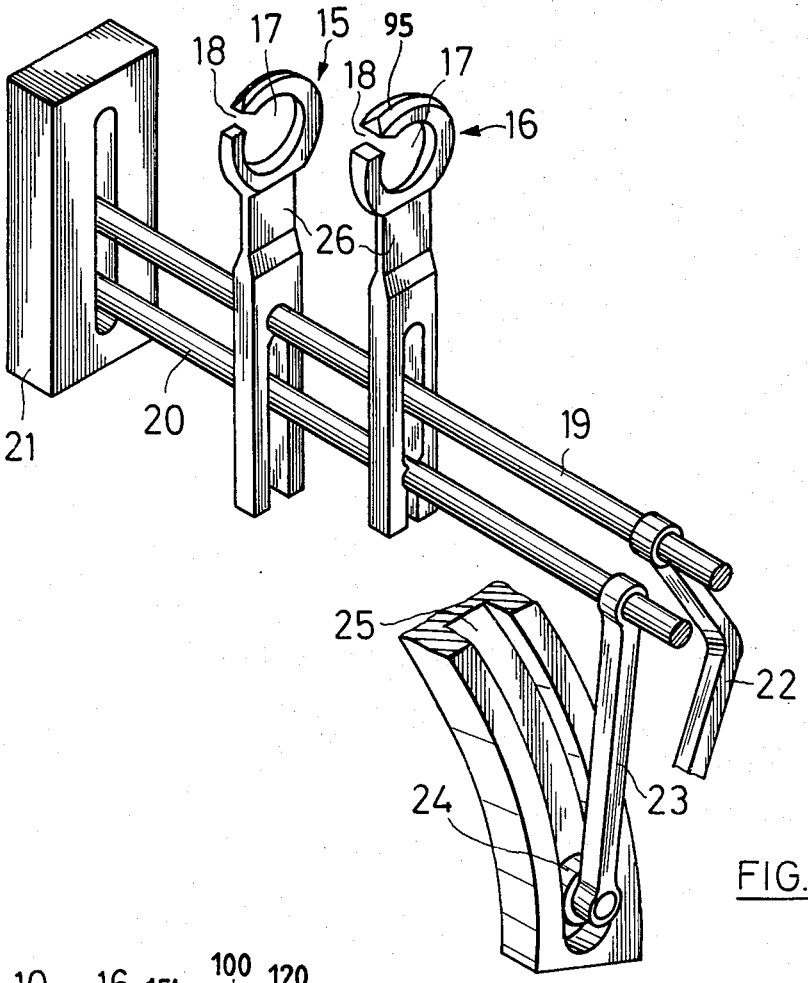
FIG. 2 is a detail of the arrangement of FIG. 1 in schematic perspective view.

In FIGS. 1 to 3 there has been illustrated the closed guide channel 100 for the weft threads in conjunction with an air nozzle loom of known design. These looms or weaving machines are so-called single-phase looms, which means that after the formation of an open shed extending over the entire loom width there is inserted in each case a weft thread and such is subsequently beaten before the next shed formation is accomplished. Apart from the single-phase looms there are also known multiphase looms wherein always a plurality of mutually stepwise shifted weft threads is inserted or layed in likewise stepwise shifted and migrating rows of open sheds. If the sheds are in each case individually formed over the width of the loom and if the successively formed sheds simultaneously migrate a number of times in the direction of the warp threads, then such type of looms are referred to in the art as multiple longitudinal traversing shed looms. They have also been referred to as warp-wave looms. The inventive closed guide channel is also suitable for such type looms; in FIGS. 4 and 5 there has been illustrated the use of the guide channel at a multiple longitudinal traversing shed loom.

Figure 4:
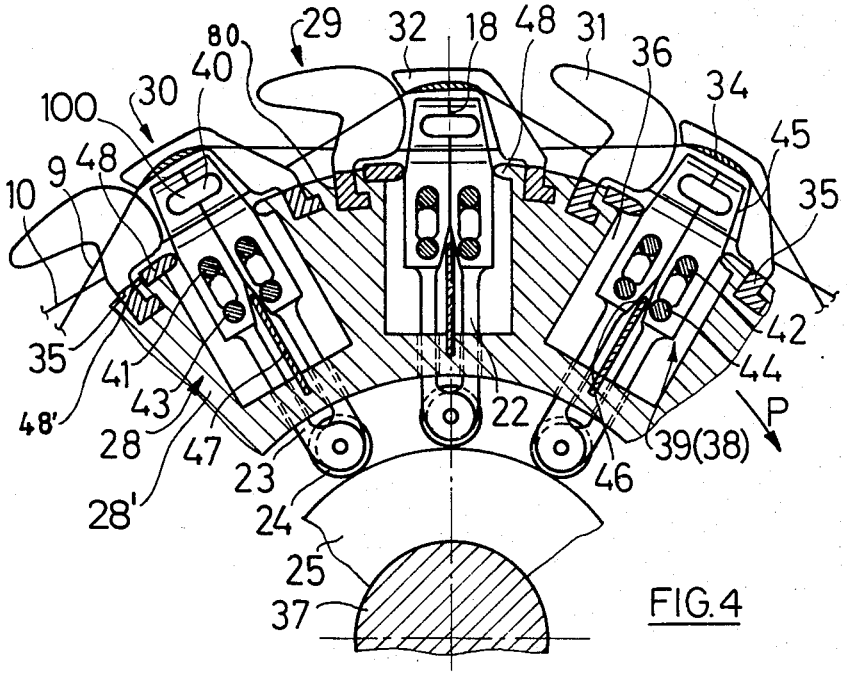
FIG. 4 is a cross-sectional view through the weaving rotor of a multiple longitudinal traversing shed loom containing thread guide channels.

Turning attention now to FIG. 4 there has been shown a fragmentary cross-sectional view through the weaving rotor 28 of a multiple longitudinal traversing shed weaving machine which, during operation, rotates in the direction indicated by the arrow P. The function and construction of such multiple longitudinal traversing shed weaving weaving machine containing a weaving rotor is here assumed to be known and therefore the details thereof need not be further considered; in this regard reference may be made to U.S. Pat. No. 2,742,058, granted Apr. 17, 1956, exemplifying one possible construction of such type warp-wave weaving machine and equally to the commonly assigned, copending U.S. applications Ser. Nos. 096,776 and 096,777, each filed Nov. 23, 1979, now respectively U.S. Pat. No. 4,290,458, granted Sept. 22, 1981 and U.S. Pat. No. 4,291,729, granted Sept. 29, 1981, to which reference may be readily had and the disclosure of which is incorporated herein by reference.

The weaving rotor 28 is constituted by a hollow roll 28' extending over the width of the weaving machine and which is supported laterally adjacent the warp threads at the machine frame and is appropriately driven by any suitable drive means arranged likewise laterally at the machine frame. At the circumference of the weaving rotor 28 there are alternately arranged beat-up combs 29 and guide combs 30 in the lengthwise direction of the weaving rotor 28, and thus, these combs extend in the weft insertion direction. At the entire circumference of the weaving rotor 28 there are provided, for instance, in each case a total of twelve to fourteen such combs.

The beat-up combs 29 comprise beat-up lamellae or elements 31 arranged at a substantially uniform spacing from one another and serve for beating-up the inserted or layed weft threads. The guide combs 30 consist of guide lamellae or elements 32, between which there are alternately arranged the shed-retaining elements which determine the upper shed position or the lower shed position of the warp threads 9 and 10. The shed-retaining elements for the upper shed position are here, for instance, constituted by projections 34 located at one side of the related guide lamellae 32 (FIG. 4). Since the warp threads 9 and 10 bear upon the shed-retaining elements 34 for the upper shed position and are tensioned, there need not be provided any special shed-retaining elements for the lower shed position, rather it is sufficient if there is instead provided in each case an intermediate space up to the outer surface of shell of the weaving rotor 28. Between the beat-up lamellae 31 of the beat-up combs 29 and the guide lamellae 32 of the guide combs 30 there are provided suitable spacer or distance elements 35.

By the action of the shed-retaining elements 34 the warp threads 9 and 10 are retained in their upper or lower shed position over the entire wrap angle between the warp threads 9 and 10 and the weaving rotor 28. The thus formed sheds migrate in tandem towards the cloth fell, and during such time when the sheds are open there are inserted in step-like offset fashion with regard to one another into each shed a weft or filling thread as is well known in the warp-wave-loom technology.

The part of the beat-up lamellae 31 protruding from the weaving rotor 28 and the guide lamellae 32 approximately have the shape of a finger which is curved opposite to the direction of rotation P of the weaving rotor 28. The inner edge of the guide lamellae 32, the shed-retaining elements 34 and the forward outer edge of the beat-up lamellae 31, viewed with respect to the direction of rotation P, bound a channel for the weft insertion.

Figure 5A:
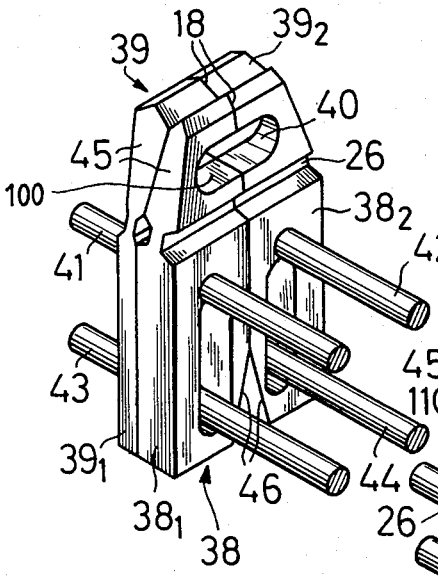
FIGS. 5A and 5B illustrate a detail of the arrangement of FIG. 4 in schematic perspective view in different operational states.

If the weft threads should be inserted with the aid of a flowing or fluent fluid medium, then this can be accomplished particularly advantageously when using a guide channel 100 which is closed in radial direction and illustrated in FIGS. 1 to 3 and also partially in FIG. 5*a*, and wherein FIG. 4 shows an embodiment by way of example.

The weaving rotor 28 is provided at its outer surface with substantially L-shaped grooves 80 in which there are supported the beat-up and guide combs 29 and 30, respectively. Between the grooves 80 and each comb pair the weaving rotor 28 is provided below the channel serving for the weft insertion and bounded by the beat-up lamellae 31 and guide lamellae 32 with a slot 36 which extends over the entire width of the weaving machine. In each slot 36 there extend and are mounted to be elevationally or displaceably adjustable two lamellae combs each of which comprises a predetermined number or set of lamellae or lamella elements 38, 39 which are alternatingly arranged over the weft thread insertion length across the width of the weaving machine. The lamellae or lamella elements 38, 39 of the lamellae combs form the closed guide channel 100 in one of their operative positions which is shown in FIG. 5A.

Figure 5B:
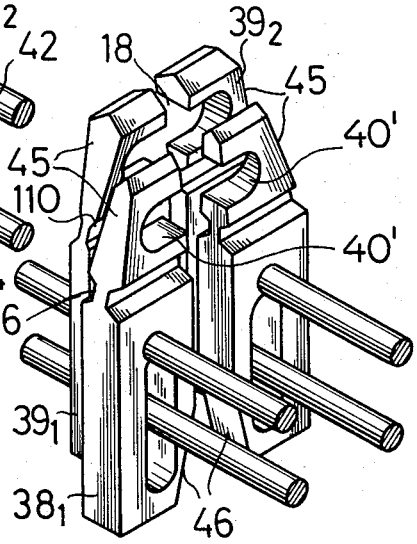

With the exemplary embodiment illustrated in FIG. 5 there is used for the fabrication of the closed thread guide channel 100 a particularly advantageous type of lamellae 38 and 39. Each of the lamellae 38, 39 is divided along a plane 18' extending longitudinally and transversely therethrough to yield two respective segments or halves, $38_1$, $38_2$ and $39_1$, $39_2$ which are visible in FIG. 5B. Each segment or half contains a related upper portion and a cut-out or recess 40' extends transversely into each upper portion from the dividing plane 18' which divides the related lamella. The segments or halves of each lamella are arranged in mirror image fashion so that the cut-outs or recesses 40' confront each other with their open sides. The cut-outs or recesses 40' of the segments or halves of each lamella 38 or 39 complement each other to define a throughpass opening 40 in the operative state of the lamellae 38, 39 shown in FIG. 5A. The throughpass openings 40 of the two sets of lamellae 38, 39 of the two lamellae combs thus form in this operative state the continuous guide channel 100 which is closed in radial direction. In this operative state the lamellae 38, 39 are immersed into the shed.

The lamella segments of halves $38_1$ and $38_2$ extend convergingly upwardly in a wedge-shaped fashion on the longitudinal sides at their upper portion forming the guide channel 100. The lamella segments or halves $39_1$ and $39_2$ extend convergingly downwardly in a wedge-shaped fashion on the longitudinal sides at their upper portion forming the guide channel 100. The wedge-shaped portions terminate at the top in a tip or edge. Towards the lower end there merges with the wedge-shaped portion a constricted or narrower part or portion 26 and there extends downwardly therefrom the base body of the related lamella. The wedge-shaped configuration of the upper portions of the segments or halves of the lamellae 38, 39 has the effect that in the operative position shown in FIG. 5A, the alternating lamellae 38, 39 of the two lamellae combs are interleaved. As a result the cut-outs 40' of the related lamella segments or halves complement each other to form the throughpass openings 40 which conjointly form, analogous to the arrangement shown in FIG. 3, the continuous or radially closed guide channel 100 in the direction of the weft insertion which occurs in this operative position of the lamellae 38, 39. In the other, inoperative position shown in FIG. 5B the segments or halves of each of the lamellae 38, 39 are spaced apart at the dividing plane 18' by an intermediate space 110, so that a related thread opening 18 is formed through which the weft thread exits after insertion prior to the beat-up phase of the weaving operation. Due to the edge-shaped termination of the wedge-shaped upper portions of the lamella segments or halves $38_1$, $38_2$, $39_1$, $39_2$ there is additionally achieved the advantage that their dipping-in or inserting movement between the warp threads 9, 10 is facilitated. Due to the presence of the intermediate space 110 in the inoperative position the free through-passage of the warp threads 9, 10 is enabled after weft insertion.

Due to the division of each lamella 38 and 39 into two lamella segments or halves $38_1$, $38_2$ and $39_1$, $39_2$, and due to the illustrated construction of the throughpass openings or passageways 40 and the mirror-image arrangement of the lamella halves, the lamellae 38 and 39 need not be elastically structured at their parts surrounding the throughpass opening 40 and there is dispensed with the stop or impact means for sealing the related thread outlet opening 18.

The closing and opening of the guide channel 100 is accomplished by a displacement or elevational movement of the two lamellae combs. For each set of segments or halves $38_1$, $38_2$, $39_1$, $39_2$ there is provided a relative drive rod 41, 42, 43, and 44, each of which essentially extends over the width of the weaving machine. The ywo sets of lamella segments or halves $38_1$, $38_2$ and $39_1$, $39_2$ are connected to respective pairs of drive rods 41, 42 and 43, 44 and each such pair of drive rods is moved by a relative drive lever 22 and 23, a common control roll or cam follower 24 and a common machine-fixed control curve or cam 25 or the like.

During the displacement movement of the individual lamellae combs it is to be observed that both lamella halves $38_1$, $38_2$ and $39_1$, $39_2$ of each lamella 38 and 39, respectively, perform the same displacement or stroke movement, as will be readily evident from FIGS. 4 and 5A, 5B, by the drive levers 22 and 23 which in each case carry a common cam follower 24. This means that opening of the guide channel 100 is not accomplished by lowering the one lamella halves or portions in relation to the other lamella halves or portions. Quite to the contrary, this opening action is accomplished by pivoting away from one another or spreading apart the relevant lamella halves. For this purpose each lamella half $38_1$, $38_2$; $39_1$, $39_2$ is provided at the outer edge of its upper portion which dips into the shed with a conical upwardly extending first guide flank 45 and its lamella body, at the contact surfaces of the lamellae bodies of both lamella halves, with a likewise conical second guide flank 46.

At the base of each slot 36 there are adhesively bonded or otherwise appropriately fixed small plates or plate members 47 in spaced relationship from one another. These plates 47 extend from the base of the slot 36 upwardly into the free intermediate space between the second guide flanks 46. As soon as the lamellae 38, 39 are moved out of the shed towards the interior of the weaving rotor 28, the small plates 47 move between the lamella bodies of the individual lamella segments or halves, so that such are spread apart. This spreading action is limited by the first guide flank 45 in that there is arranged a respective bead or nose 48 or equivalent structure at the upper end of the side wall of the slot 36, along which there can slide the related first guide flank 45 during such time as the lamellae move out of the shed.

In order to be able to accomplish adjustment of the width of the thread exit or outlet opening 18 which is formed during spreading apart of th lamella segments or halves as well as for accomplishing a fine regulation, it is particularly advantageous if one of both beads or noses 48 of each slot or gap 36 is constructed to be adjustable in a direction perpendicular to the lamellae side edge. In FIG. 5 such is the left bead 48 which is formed by an adjustable rail 48'. This rail 48' can be attached, for instance threadably screwed, at the weaving rotor 28.

As will be best recognized by referring to FIG. 5B, the individual lamellae 38 and 39 carry out displacement movements of different magnitude. The wedge-shaped downwardly converging lamellae 39 are only lowered to such an extent that there is formed a sufficiently wide thread exit or outlet opening 18. The wedge-shaped upwardly converging lamellae 38 are lowered to a greater extent in relation to the lamellae 39, so that there is formed between the upper portions of the individual lamellae an intermediate space 110 which renders possible the free throughpassage of the warp threads. The lamellae 38 therefor need not be moved completely to a location below the shell or outer surface of the weaving rotor 28, because the actual departure of both lamella types 38 and 39 out of the warp threads 9 and 10 is accomplished by the rotational movement of the weaving rotor 28 specifically, in the phase prior to beating-up of the relevant weft or filling thread. During this phase also the shed-retaining elements 34 move below the beat-up plane.

During the displacement movement of the lamellae 38 and 39 or during their movement out of the warp threads 9 and 10 the weft threads can not be drawn into the slots 36, since they bear upon the warp threads of the lower shed.

Since the individual lamellae 38 and 39 perform displacement movements of different magnitudes, they and along therewith the rods 41, 42 and 43, 44, respectively, carrying the related lamella segments or halves, are deflected laterally to different extents by the small plates 47 or equivalent structure. It is for this reason that the slots surrounding the rods 41, 42, 43, 44 and provided in the lamella bodies are widened in each case towards one side, so that the rods 41, 42 or 43, 44 for the one lamellae 38 and 39, respectively, possess sufficient play for such lateral deflection within the slots of the other lamellae 39 or 38, as the case may be.

The closed guide channel illustrated in FIGS. 4 and 5A, 5B is not limited to use in a multiple longitudinal traversing shed weaving apparatus or loom, and, of course, can also be beneficially employed at single-phase pneumatic looms.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for guiding a weft thread within the shed of a weaving machine and which is driven by a flowing fluid medium, comprising:

two lamellae combs which are capable of dipping into and out of the shed and between warp threads thereof;

each of said two lamellae combs comprising a predetermined number of lamella elements;

said lamella elements of said two lamellae combs being alternatingly arranged across the width of the weaving machine;

each said lamella element having a throughpass opening for guiding an inserted weft thread and a thread outlet opening;

each said lamella element being divided along a predetermined dividing plane into two lamella segments;

each said lamella segment being provided with a cut-out extending from said dividing plane;

means for moving said two lamellae combs between an operative position, in which the lamella elements are dipped into the shed, and an inoperative position, in which the lamella elements are dipped out of the shed;

said lamella elements, in the operative position of the two lamella combs, contacting each other and said lamella segments of each said lamella element contacting each other at the related dividing plane such that said thread outlet opening of each lamella element is closed and said cut-outs of the two lamella segments of each lamella element complement each other and define the throughpass opening, and forming, by means of their throughpass openings, a guide channel for weft insertion in a predetermined weft insertion direction;

said guide channel being essentially continuous in said weft insertion direction and being continuously closed in radial direction; and said lamella segments of said lamella elements, in the inoperative position of said two lamellae combs, being spread apart at said dividing plane such that said thread outlet openings are open.

2. The apparatus as defined in claim 1, wherein:

the weaving machine comprises a multiple longitudinal traversing shed weaving machine including:

a weaving rotor provided at its circumference with comb means of shed-retaining elements for the warp threads for forming migrating rows of open sheds; and said two lamellae combs being provided at said weaving rotor for each one of said comb means of the shed-retaining elements and thus for each row of open sheds.

3. The apparatus as defined in claim 2, wherein:

said weaving rotor comprises a hollow roll extending substantially over the width of the weaving machine;

respective slots at the site of each said two lamellae combs being provided at said hollow roll; and each said two lamellae combs being displaceably mounted in their related slots.

4. The apparatus as defined in claim 3, wherein:

each said lamella element of each said lamellae comb is divided along said dividing plane constituting a longitudinally and transversely extending central dividing plane in order to form two lamella halves.

5. The apparatus as defined in claim 4, wherein:

each one of said two lamella halves of each lamella element is provided at the dividing plane and at the region of an end confronting the lengthwise axis of the weaving rotor with a respective conical guide flank;

the guide flanks of said two lamella halves forming a wedge-shaped gap which converges towards the outer surface of the weaving rotor in the related lamella element;

said related slot in said hollow roll of said weaving rotor having a base at which there are mounted the related two lamellae combs;

separation elements arranged at the base of the related slot and directed towards said gaps in said lamella elements of said two lamella combs; and said separation elements, during the dipping movement of said two lamellae combs out of the row of open sheds, penetrating into said gaps and thus spreading the lamella halves away from one another.

6. The apparatus as defined in claim 5, wherein:

said separation elements constitute plate members attached at said base of said related slot in said hollow roll of said weaving rotor.

7. The apparatus as defined in claim 6, wherein:

each said lamella half is provided at an outer edge of a part thereof containing the cut-out with a further conical guide flank;

said further guide flanks of each two lamella halves of a related lamella element forming two legs of a trapezoid;

said related slot in said hollow roll of said weaving rotor being provided with bead means located on opposite sides and operatively associated with said further guide flanks at the lamella elements of said two lamellae combs; and each of the further guide flanks bearing against said bead means provided in the related slot and being guided at said bead means during their dipping-out movement.

8. The apparatus as defined in claim 7, wherein:

the bead means on one of said opposite sides of said related slot being adjustable relative to its operatively associated further guide flanks.

9. The apparatus as defined in claim 1, further including:

a respective rod member at which there are fixed the lamella halves of one lamella element of each one of the two lamellae combs;

each said rod member extending essentially over the width of the loom;

respective drive lever means having an end each engaging at a related one of said rod members;

each said drive lever means having a respective opposite end; and related control roll means carried by said opposite end of each said drive lever means.

10. The apparatus as defined in claim 9, wherein:

each said drive lever means engaging the rod members at which the lamella halves of the related lamella elements of one of said two lamellae combs are fixed, is provided with said control roll means defining common control roll means.

11. The apparatus as defined in claim 10, further including:

control cam means fixed to the weaving machine for controlling each one of said control roll means.

12. The apparatus as defined in claim 11, wherein:

the weaving machine comprises a multiple longitudinal traversing shed weaving machine including a weaving rotor;

a shaft extending internally of said weaving rotor over the width of the weaving machine; and said control cam means being mounted upon said shaft.

13. The apparatus as defined in claim 1, wherein:

each said lamellae comb being displaceable in a predetermined displacement direction;

each said lamella element of said two lamellae combs having an end surface of substantially wedge-shaped configuration in said predetermined displacement direction;

said substantially wedge-shaped end surfaces of said lamella elements at one of said two lamellae combs defining wedge means converging in said predetermined displacement direction; and said substantially wedge-shaped end surfaces of the lamella elements at the other one of said two lamellae combs defining wedge means converging opposite to said predetermined displacement direction.

14. The apparatus as defined in claim 13, wherein:

each said lamella element of said two lamellae combs is provided with a constricted portion following said wedge means; and said constricted portions being spaced from the throughpass openings of said lamella elements such that, in said operative position thereof, the warp threads cross said lamella elements at the region of said constricted portions.

* * * * *

UNITED STATES PATENT AND TRADEMARK OFFICE

CERTIFICATE OF CORRECTION

PATENT NO. : 4,492,255

DATED : January 8, 1985

INVENTOR(S) : ALOIS STEINER

It is certified that error appears in the above-identified patent and that said Letters Patent is hereby corrected as shown below:

Column 1, line 42, please delete "neightboring" and insert --neighboring--

Column 2, line 29, please delete "considerable" and insert --considerably--

Column 6, line 35, please delete "5" and insert --5A, 5B--

Column 6, line 43, please delete "weaving" (first occurrence)

Column 7, line 45, please delete "5a" and insert --5A--

Column 9, line 3, please delete "ywo" and insert --two--

Column 9, line 46, please delete "th" and insert --the--

Column 9, line 66, please delete "therefor" and insert --therefore--

Signed and Sealed this

*Second* Day of *July 1985*

[SEAL]

*Attest:*

DONALD J. QUIGG

*Attesting Officer* *Acting Commissioner of Patents and Trademarks*